US009677407B2

(12) United States Patent
Borja et al.

(10) Patent No.: US 9,677,407 B2
(45) Date of Patent: Jun. 13, 2017

(54) ROTOR COVER PLATE

(71) Applicant: United Technologies Corporation, Hartford, CT (US)

(72) Inventors: Mark Borja, Palm Beach Gardens, FL (US); Ehren B. Holt, Juno Beach, FL (US)

(73) Assignee: United Technologies Corporation, Farmington, CT (US)

( * ) Notice: Subject to any disclaimer, the term of this patent is extended or adjusted under 35 U.S.C. 154(b) by 863 days.

(21) Appl. No.: 13/737,093

(22) Filed: Jan. 9, 2013

(65) Prior Publication Data

US 2014/0190181 A1 Jul. 10, 2014

(51) Int. Cl.
*F01D 5/30* (2006.01)

(52) U.S. Cl.
CPC ..... *F01D 5/3069* (2013.01); *F01D 5/3015* (2013.01)

(58) Field of Classification Search
CPC .... F01D 5/3015; F01D 5/3007; F01D 5/3069; F01D 11/001; F01D 11/008; F01D 11/02; F05D 2260/30
See application file for complete search history.

(56) References Cited

U.S. PATENT DOCUMENTS

| | | | | |
|---|---|---|---|---|
| 4,558,988 | A | 12/1985 | Kisling et al. | |
| 5,498,139 | A | 3/1996 | Williams | |
| 6,106,234 | A * | 8/2000 | Gabbitas | F01D 5/3015 416/220 R |
| 6,190,131 | B1 | 2/2001 | Deallenbach | |
| 6,971,855 | B2 * | 12/2005 | Richards | F04D 29/34 416/220 R |
| 7,371,050 | B2 * | 5/2008 | Pasquiet | F01D 5/3015 416/204 A |
| 8,038,397 | B2 | 10/2011 | Saddoughi et al. | |
| 8,277,177 | B2 | 10/2012 | Liang | |
| 2009/0148295 | A1 * | 6/2009 | Caprario | F01D 5/3015 416/193 A |
| 2009/0162192 | A1 * | 6/2009 | McCaffrey | F01D 17/162 415/160 |
| 2012/0177485 | A1 | 7/2012 | Virkler et al. | |

FOREIGN PATENT DOCUMENTS

| | | |
|---|---|---|
| DE | 60318977 | 2/2009 |
| EP | 2009236 | 12/2008 |

* cited by examiner

*Primary Examiner* — Craig Kim
*Assistant Examiner* — Juan G Flores
(74) *Attorney, Agent, or Firm* — Kinney & Lange, P.A.

(57) ABSTRACT

A cover plate for a rotor disk in a gas turbine machine includes a cylindrical body having multiple outward facing snaps and multiple inward facing snaps.

20 Claims, 3 Drawing Sheets

ROTOR COVER PLATE

TECHNICAL FIELD

The present disclosure is related generally to gas powered turbines, and more particularly to rotor disk cover plates for use within a gas powered turbine.

BACKGROUND OF THE INVENTION

Gas powered turbines, such as those used in ground base turbine generators, utilize multiple stages including turbine stages and compressors stages. Compressor systems and turbine systems are collectively referred to as rotor systems and include multiple rotating disks referred to as rotor disks.

The rotor systems within a turbine use sealing mechanisms near the gas path rim of each of the rotor disks to prevent secondary air system air from entering the gas path. Typical sealing mechanisms involve a rotating to static hardware seal. The size of the gap between the rotating piece and the static piece directly affects the amount of gasses that cross the gap and affect engine performance.

One type of seal utilized in rotor systems is a knife edged seal utilizing a knife edge protrusion as the rotating piece in the seal arrangement. The knife edge protrusion is connected to the rotor disk by a cover plate. The knife edge protrusion interfaces with a corresponding static component to form a seal and minimize gas leakage between the secondary air systems and the gas path. The cover plates are intentionally made small relative to the rotor disks in order to minimize the centrifugal load imparted to the rotors to which the cover plates are attached.

SUMMARY OF THE INVENTION

According to an exemplary embodiment of this disclosure, among other possible things, a gas turbine machine includes a compressor section, a combustor in fluid communication with the compressor section, a turbine section in fluid communication with the combustor section, a shaft defining an axis and interconnecting the compressor section and the turbine section, a plurality of rotors within the turbine section and the compressor section, each of the rotors is connected to the shaft, at least one cover plate connected to each of the plurality of rotors, each of the cover plates includes an outside surface snap contacting a radially inward facing surface relative to the axis of the corresponding rotor, an inside surface snap contacting a radially outward facing surface relative to the axis of the corresponding rotor, and the outside surface snap and the inside surface snap are not radially aligned.

In a further embodiment of the foregoing gas turbine machine, each of the rotors includes at least one rotor arm protruding axially away from the rotors, and the rotor arm interfaces with a corresponding cover plate.

In a further embodiment of the foregoing gas turbine machine, the rotor arm interfaces with the cover plate via a fastener.

In a further embodiment of the foregoing gas turbine machine, the fastener protrudes through the cover plate and the rotor arm.

In a further embodiment of the foregoing gas turbine machine, the radially outward facing surface is a surface on the rotor arm.

In a further embodiment of the foregoing gas turbine machine, the cover plate further includes an flexing portion operable to be flexed during installation and to return to an unflexed state after installation without permanent deformation.

In a further embodiment of the foregoing gas turbine machine, the cover plate includes at least one sealing feature.

In a further embodiment of the foregoing gas turbine machine, the at least one sealing feature is a knife edge seal.

In a further embodiment of the foregoing gas turbine machine, the inside surface snap tightens as the cover plate cools.

In a further embodiment of the foregoing gas turbine machine, the outside surface snap tightens as the cover plate heats.

In a further embodiment of the foregoing gas turbine machine, the cover plate and a corresponding rotor are constructed of different materials having different thermal expansion rates.

In a further embodiment of the foregoing gas turbine machine, the gas turbine machine further includes a second cover plate corresponding to each of the rotors.

In a further embodiment of the foregoing gas turbine machine, the cover plate is a single cylindrical piece including a central opening.

According to an exemplary embodiment of this disclosure, among other possible things, a cover plate for a rotor disk in a gas turbine machine includes, a cylindrical body defining an axis, an opening in the cylindrical body the opening is centered on the axis, a plurality of outwardly facing snaps having a contact surface facing radially outward relative to the axis, and a plurality of inwardly facing snaps having a contact surface facing radially inwards relative to the axis.

In a further embodiment of the foregoing cover plate for a gas turbine machine, the outwardly facing snaps and the inwardly facing snaps are not axially aligned.

In a further embodiment of the foregoing cover plate for a gas turbine machine, the cylindrical body further includes a spring region operable to be flexed during installation and operable to return to an unflexed position after installation.

In a further embodiment of the foregoing cover plate for a gas turbine machine, the cover plate includes at least one sealing element.

In a further embodiment of the foregoing cover plate for a gas turbine machine, the sealing element is a knife edge seal.

These and other features may be best understood from the following specification and drawings, the following which is a brief description.

DETAILED DESCRIPTION

Figure 1:
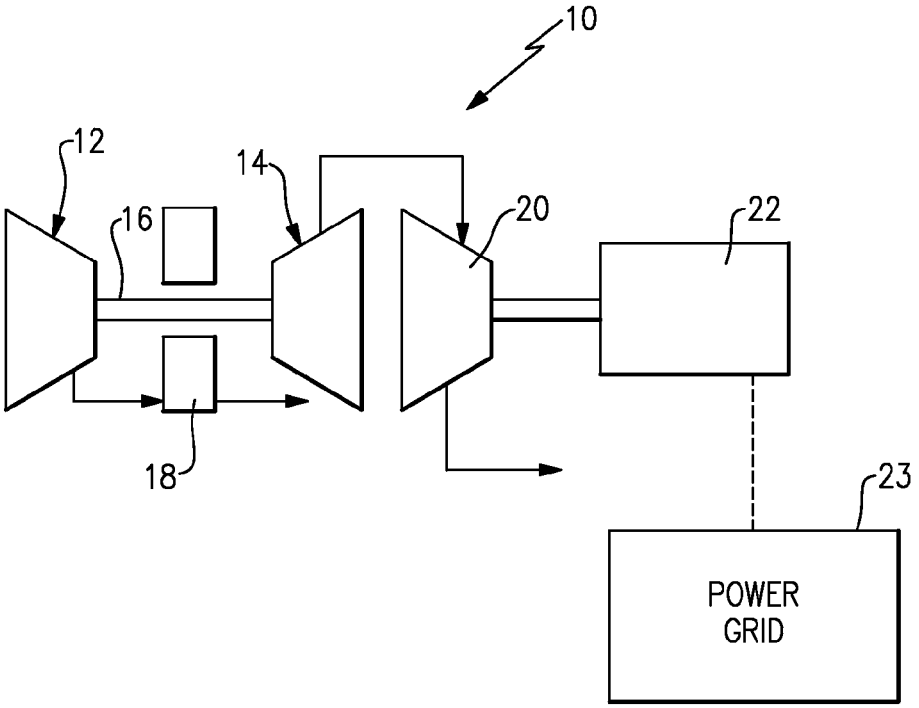
FIG. 1 schematically illustrates a ground based gas powered turbine machine.

A schematic view of an industrial gas turbine engine 10 is illustrated in FIG. 1. The engine 10 includes a compressor section 12 and a turbine section 14 interconnected to one another by a shaft 16. A combustor 18 is arranged between the compressor and turbine sections 12, 14. A generator 22 is rotationally driven by a shaft coupled to the turbine or uncoupled via a power turbine, which is connected to a power grid 23. It should be understood that the illustrated engine 10 is highly schematic, and practical implementations may vary from the configuration illustrated. Moreover, the disclosed rotor disk cover plate may be used in commercial and military aircraft engines as well as industrial gas turbine engines. The compressor and turbine sections 12, 14 are collectively referred to as rotor systems.

Within the rotor systems of the industrial gas turbine engine 10 are multiple rotor disks, each of which includes a cover plate supporting a sealing arrangement that reduces the amount of gases that cross the gap between a rotating piece and a static piece thereby reducing the amount of gases that can travel between secondary air systems and a gas path of the industrial gas turbine engine 10.

Figure 2:
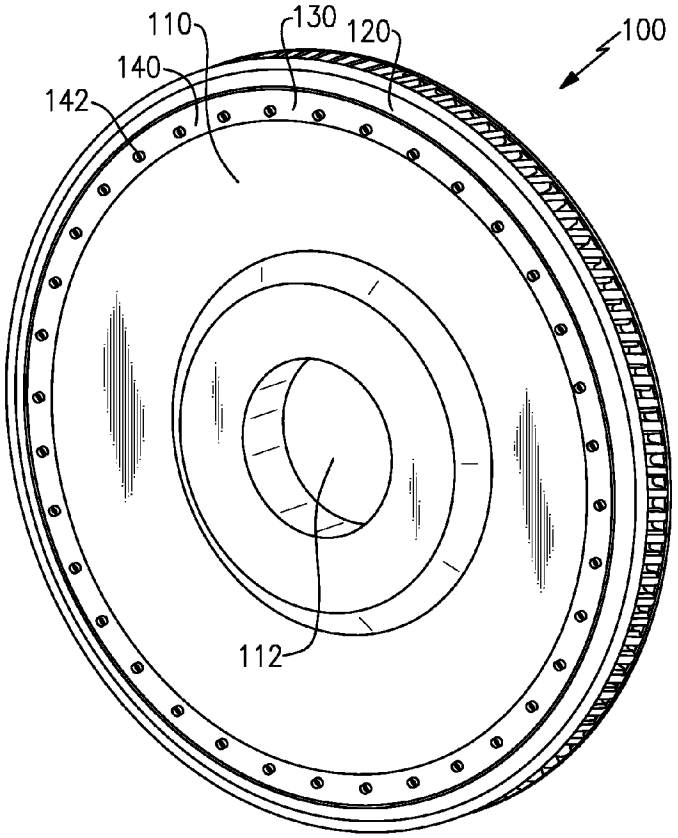
FIG. 2 schematically illustrates a rotor disk for use in the rotor systems of the ground based turbine machine of FIG. 1.

FIG. 2 schematically illustrates an example rotor disk assembly 100 isolated from the industrial gas turbine engine 10 of FIG. 1. The example rotor disk assembly 100 includes a rotor disk 110 with a shaft opening 112 through the center of the rotor disk 110. The shaft opening 112 defines an axis that is coaxial with a turbine engine 10 centerline axis defined by the shaft 16 when the rotor disk assembly 100 is installed within the turbine engine 10. A rotor cover plate 120 is mounted to a radially outward edge of the rotor disk 110 via multiple fastener features 142. The rotor disk 110 includes a rotor disk arm 130 protruding axially away from the rotor disk 110 on each side of the rotor disk 110 and interfacing with the fastener features 142 of cover plates. The rotor disk arm 130 and the fastener feature 142 interface via a fastener such as a bolt type fastener. In the illustrated example one rotor disk arm 130 protrudes from a fore (upstream) side of the rotor disk assembly 100 and the other rotor disk arm 130 protrudes from an aft (downstream) side of the rotor disk assembly 100. Alternate embodiments utilizing a single rotor disk cover plate connection utilize a single rotor disk arm or the corresponding side of the rotor disk 110.

Figure 3:
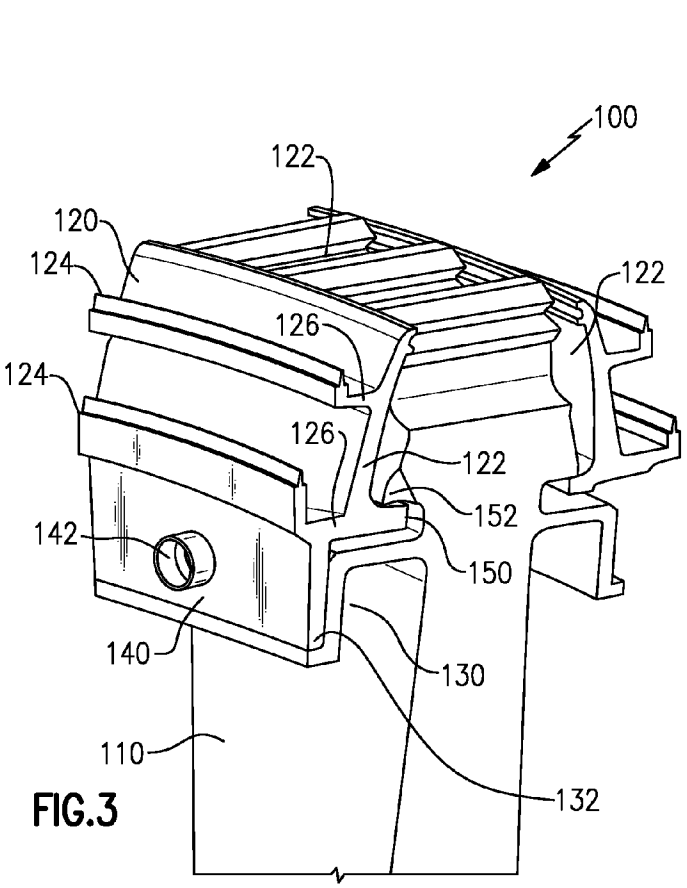
FIG. 3 schematically illustrates a sectional view of the rotor disk of FIG. 2.

With continued reference to FIG. 2, FIG. 3 illustrates a sectional view of the radially outward edge of a rotor disk assembly 100 of FIG. 2, with like numerals indicating like elements. In addition to being connected to the rotor disk 110 via the fastener feature 142, the rotor disk cover plate 120 contacts the rotor disk 110 via two opposing surfaces. Each of the two opposing surfaces are located on rotor disk cover plate 120 protrusions, referred to as snaps 140, 150, that extend from the rotor disk cover plate 120.

The radially outward snap 150 contacts a surface 152 of the rotor disk 110. The surface 152 is radially inward facing relative to the engine centerline axis and prevents the cover plate 120 from shifting radially once the cover plate 120 is installed. The radially inward snap 140 of the cover plate 120 contacts a radially outward facing surface 132 of the rotor disk arm 130. The radially outward facing surface 132 also prevents the cover plate 120 from shifting radially due to contact with the radially inward facing snap 140.

The cover plate 120 further includes two knife edge sealing elements 124 connected to the cover plate 120 via a webbing 126. The webbing 126 also connects each of the snaps 140, 150, and is the main body portion of the cover plate 120. The particular thickness, angles, and cross sections of a practical application of the webbing 126 are designed according to known principles to provide full support with minimal weight to the knife edge sealing elements 124. The illustrated thickness, angles, and cross sections are not to scale and are drawn for general illustrative effect.

Figure 4:
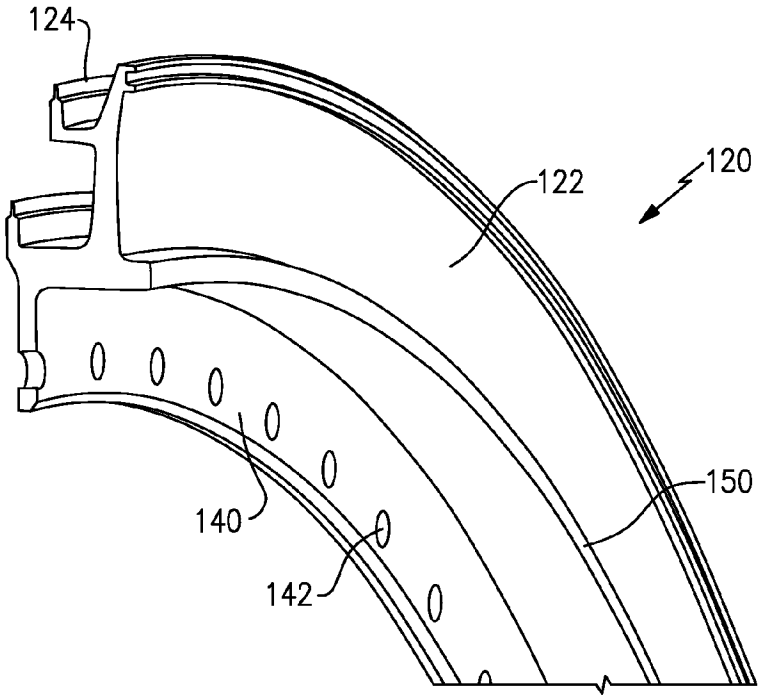
FIG. 4 schematically illustrates a partial view of a cover plate for the rotor disk of FIG. 2.
Figure 5:
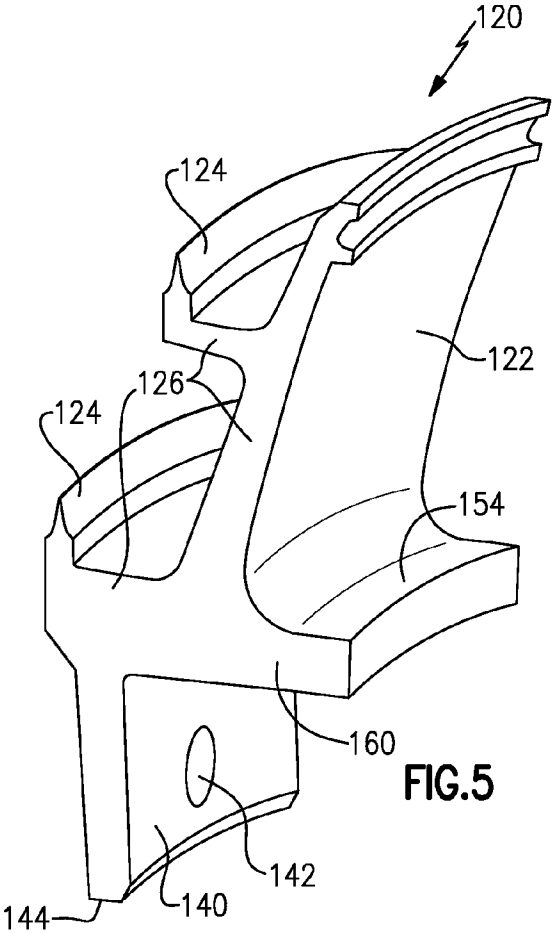
FIG. 5 schematically illustrates a sectional view of the cover plate for the rotor disk of FIG. 2.

With continued reference to FIGS. 2 and 3, FIGS. 4 and 5 illustrate the cover plate 120 of FIGS. 2 and 3 separated from the rotor disk assembly 100. FIG. 4 illustrates an inside surface 122 of the cover plate 120 and FIG. 5 illustrates a sectional view of the same, with like numerals between FIGS. 2-5 indicating like elements. As can be seen in FIGS. 4 and 5, the radially outward snap 150 has a contact surface 154 that contacts a corresponding radially inward facing surface 152 of the rotor disk 110. Similarly, the radially inward snap 140 includes a radially inward facing contact surface 144 that contacts a radially outward facing surface 132 of the rotor disk arm 130. In some examples, such as the illustrated example, the radially inward facing contact surface 144 and the corresponding rotor disk arm contact surface 132 are contoured. In alternate examples, the surfaces 144, 132 are planar.

In order to allow for assembly of the rotor disk assembly 100 and to distribute centrifugal loading, the inner snap 140 and the outer snap 150, and specifically the snap contact surfaces 154, 144, are not aligned radially. That is, a single radial line normal to the centerline axis does not intersect both snaps 140 and 150. In alternate examples, the snaps are partially aligned, where a single radial line can intersect both snaps 140, 150 but does not pass through a center point of either snap 140, 150.

In order to allow for assembly of the rotor disk assembly 100 and to distribute centrifugal loading, the inner snap 140 and the outer snap 150, and specifically the snap contact surfaces 153, 144, are not aligned radially. That is, a single radial line normal to the centerline axis does not intersect both snaps 140 and 150. In alternate examples, the snaps are partially aligned, where a single radial line can intersect both snaps 140, 150 but does not pass through a center point of either snap 140, 150.

The cover plate 120 also includes a flexing region 160 within the webbing 126 connecting the inner snap 140 and the outer snap 150. The flexing region 160 is flexed during installation, easing the positioning of the snaps 140, 150 against the rotor disk 110 and between the contact surfaces 132 and 152. In an alternate embodiment, the flexing region 160 is located on the rotor disk arm 130, and the rotor disk arm 130 is flexed during installation to the same affect. In both examples, the flexing region 160 provides flexing within an elastic deformation range to allow the webbing 126 or the rotor disk arm 130 to return to a non-flexed shape without permanent deformation.

During operation of the turbine engine 10, the rotor disk assembly 100 heats up and cools down depending on the operations mode of the turbine engine 10, and the speed of the rotation of the rotor systems within the turbine engine 10. The cover plate 120 has a significantly smaller mass than the rotor disk 110. As a result of the smaller mass, the cover plate 120 heats and cools faster than the rotor disk 110 when exposed to similar conditions. The disparity in heating and cooling rate necessarily includes a corresponding disparity in thermal expansion and contraction between the cover plate 120 and the rotor disk 110. Cover plates with a single snap instead of the illustrated double snap 140, 150 are installed with the single snap under a significant preload in order to prevent the snap from coming loose as the cover plate cools down and contracts relative to the rotor disk.

By using opposing snap directions (radially inward facing and radially outward facing snaps 140, 150) the cover plate 120 ensures that at least one snap 140, 150 grows tighter as the cover plate 120 heats up relative to the rotor disk 110, and another snap 140, 150 grows tighter and contracts relative to the rotor disk 110 as the system cools down. In the illustrated example, the radially outward facing snap 150 grows tighter as the cover plate heats (expands) relative to the rotor disk 110 because expanding the cover plate 120 shifts each aspect of the cover plate 120 radially outward and the radially outward snap 150 is contacting (stopped by) a radially inward facing contact surface 152 of the rotor disk 110. Similarly, the radially inward snap 140 growiss tight as the cover plate 120 cools (contracts) relative to the rotor disk 110, because the contracting cover plate 120 shifts radially inward relative to the rotor disk 110 and the snap 140 contacts a radially outward facing surface 132.

To further optimize for the disparate thermal expansion of the cover plate 120 and the rotor disk 110, some example rotor systems utilize a different material for the cover plate 120 then the rotor disk 110, with each of the materials having different thermal expansion coefficients. By designing the rotor systems to utilize different materials, a designer can exert greater control over the thermal expansion and contraction rates, and thus on the corresponding snap forces.

As seen in FIGS. 2 and 3, each of the rotor disk assemblies 100 in the illustrated turbine engine 10 includes a cover plate 120 on a fore side (upstream) of the rotor disk 110 and a cover plate 120 on an aft side (downstream) of the rotor disk 110. Alternate examples can be utilized in which only a single cover plate 120 is connected to either the fore or the aft side of the rotor disk 110.

It is further understood that while the illustrated example of FIG. 2 shows 36 inwardly facing snaps 140 and 108 outwardly facing snaps 150, a practical application of the above disclosure could include any number of radially inwardly facing snaps 140 and any number of radially outwardly facing snaps 150 and still fall within the above disclosure.

The invention claimed is:

1. A gas turbine machine comprising:

a compressor section;

a combustor section in fluid communication with the compressor section;

a turbine section in fluid communication with the combustor section;

a shaft defining an axis and interconnecting said compressor section and said turbine section;

a plurality of rotors within said turbine section and said compressor section, wherein each of said rotors is connected to said shaft;

a cover plate connected to one of the plurality of rotors, wherein said cover plate includes:

an outside surface snap that contacts a radially inward facing surface relative to said axis of the corresponding rotor, and that contacts the radially inward facing surface more tightly as the cover plate expands thermally with respect to the corresponding rotor;

an inside surface snap that contacts a radially outward facing surface relative to said axis of the corresponding rotor, and that contacts the radially outward facing surface more tightly as the cover plate contracts thermally with respect to the corresponding rotor; and wherein said outside surface snap and said inside surface snap are not radially aligned; and wherein any heating or cooling of the cover plate and rotor disk causes one of the outside surface snap and the inside surface snap to radially contact the corresponding rotor more tightly.

2. The gas turbine machine of claim 1, wherein said one of the plurality of rotors comprises at least one rotor arm protruding axially away from said one of the plurality of rotors, and wherein said rotor arm interfaces with the cover plate.

3. The gas turbine machine of claim 2, wherein said rotor arm interfaces with said cover plate via a fastener.

4. The gas turbine machine of claim 3, wherein said fastener protrudes through said cover plate and said rotor arm.

5. The gas turbine machine of claim 1, wherein said cover plate further comprises a flexing portion operable to be flexed during installation.

6. The gas turbine machine of claim 1, wherein said cover plate comprises at least one sealing feature.

7. The gas turbine machine of claim 6, wherein said at least one sealing feature is a knife edge seal.

8. The gas turbine machine of claim 1, wherein said inside surface snap tightens as the cover plate cools.

9. The gas turbine machine of claim 1, wherein said outside surface snap tightens as the cover plate heats.

10. The gas turbine machine of claim 1, wherein said cover plate and a corresponding rotor are constructed of different materials having different thermal expansion rates.

11. The gas turbine machine of claim 1, further comprising a second cover plate connected to the one of the plurality of rotors.

12. The gas turbine machine of claim 1, wherein each of the plurality of inside surface snaps is situated at a radially innermost distal end of the cover plate.

13. The gas turbine machine of claim 1, wherein each of the plurality of outside surface snaps and each of the plurality of inside surface snaps are connected by an intervening radially and axially extending portion of the cover plate having an L-shaped cross-section.

14. The gas turbine machine of claim 1, wherein each of the radially inward facing surface and radially outward facing surface has a non-planar contour in the axial direction.

15. A cover plate for a rotor disk in a gas turbine machine comprising:

a cylindrical body defining an axis;

an opening in said cylindrical body wherein said opening is centered on said axis;

a plurality of outwardly facing snaps each having a contact surface facing radially outward relative to said axis, and contacting a radially inward facing surface of the rotor disk, such that thermal expansion of the cover plate relative to the disk causes the outward facing surface of the outward facing snap to contact the inward facing surface of the disk more tightly; and a plurality of inwardly facing snaps each having a contact surface facing radially inward relative to said axis, and contacting a radially outward facing surface of the rotor disk, such that thermal contraction of the cover plate relative to the disk causes the inward facing surface of the inward facing snap to contact the outward facing surface of the disk more tightly;

wherein any heating or cooling of the cover plate and rotor disk causes one of the plurality of inwardly facing snaps and the plurality of outwardly facing snaps to radially contact the rotor disk more tightly.

16. The cover plate for a gas turbine machine of claim 15, wherein said plurality of outwardly facing snaps and said plurality of inwardly facing snaps are not radially aligned.

17. The cover plate for a gas turbine machine of claim 15, wherein said cylindrical body further comprises a spring region operable to be flexed during installation.

18. The cover plate for a gas turbine machine of claim 15, wherein said cover plate comprises at least one sealing element.

19. The cover plate for a gas turbine machine of claim 18, wherein said sealing element is a knife edge seal.

20. The cover plate for a gas turbine machine of claim 15, wherein the inward facing surface of the inward facing snap has a non-planar contour in the axial direction.

* * * * *